US005501353A

United States Patent [19]

Warren

[11] Patent Number: 5,501,353

[45] Date of Patent: Mar. 26, 1996

[54] COLLAPSIBLE CONTAINER

[75] Inventor: Gary F. Warren, Booyal, Australia

[73] Assignee: Bush House Pty Ltd, Australia

[21] Appl. No.: 204,364

[22] PCT Filed: Sep. 10, 1992

[86] PCT No.: PCT/AU92/00482

§ 371 Date: Mar. 11, 1994

§ 102(e) Date: Mar. 11, 1994

[87] PCT Pub. No.: WO93/04952

PCT Pub. Date: Mar. 18, 1993

[30] Foreign Application Priority Data

Sep. 11, 1991 [AU] Australia ..... PK8319

[51] Int. Cl.[6] ..... B65D 19/12; B65D 19/16

[52] U.S. Cl. ..... 220/6; 220/1.5; 220/681; 217/15; 217/47

[58] Field of Search ..... 220/6, 681, 1.5; 217/14, 46, 47, 15

[56] References Cited

U.S. PATENT DOCUMENTS

| | | | |
|---|---|---|---|
| 3,403,806 | 10/1968 | Pohl | 220/6 |
| 3,658,035 | 4/1972 | Harris | 220/6 |
| 3,707,811 | 1/1973 | Hampson . | |
| 3,752,349 | 8/1973 | Rana | 220/6 |
| 3,832,811 | 9/1974 | Briel, Jr. . | |
| 3,992,828 | 11/1976 | Ohe . | |
| 4,091,950 | 5/1978 | Craven | 220/6 |
| 4,742,653 | 5/1988 | Napier et al. . | |

FOREIGN PATENT DOCUMENTS

| | | | |
|---|---|---|---|
| 259368 | 5/1963 | Australia . | |
| 1903867 | 9/1968 | Australia . | |
| 2373967 | 1/1969 | Australia . | |
| 4645768 | 5/1970 | Australia . | |
| 2208370 | 5/1972 | Australia . | |
| 1574476 | 7/1976 | Australia . | |
| 8405975 | 2/1977 | Australia . | |
| 1331776 | 10/1977 | Australia . | |
| 8109782 | 9/1982 | Australia . | |
| 6209986 | 3/1987 | Australia . | |
| 3480089 | 11/1989 | Australia | B65D 19/12 |
| 5136190 | 9/1990 | Australia . | |
| 5503890 | 12/1990 | Australia . | |
| 6111890 | 2/1991 | Australia . | |
| 2557620 | 7/1985 | France . | |
| 1183662 | 8/1965 | Germany . | |
| 3500427 | 7/1986 | Germany . | |
| 1611807 | 12/1990 | U.S.S.R. . | |
| 910606 | 11/1962 | United Kingdom . | |
| 1223064 | 2/1971 | United Kingdom . | |
| 1565497 | 12/1976 | United Kingdom . | |
| 2188609 | 10/1987 | United Kingdom | B65D 19/12 |
| 7900236 | 11/1979 | WIPO . | |
| 9000345 | 8/1990 | WIPO . | |

*Primary Examiner*—David Scherbel
*Assistant Examiner*—Reginald L. Alexander
*Attorney, Agent, or Firm*—Hayes, Soloway, Hennessey, Grossman & Hage

[57] ABSTRACT

A collapsible container is defined having: a container base, a plurality of support members extending generally upwardly from the container base and a plurality of wall members each mounted to at least one respective support member by a hinge. Each wall member is movable between an erected position where the wall member extends generally away from the container base and a collapsed position where the wall member generally overlays the container base. Each wall member as top, bottom and side edges extending between inner and outer faces. The inner face lie s closer to the container base than the outer face in the collapsed position. The hinge has a hinge pin extending between each wall member and respective support member. The hinge pin is rotatably supported at one or both of the wall member and support member, and is located on the side edge closer to the inner face than the outer face and closer to the bottom edge than the top edge. The wall members are mounted such that in the collapsed position they generally overlay each other adjacent the container base so that each is generally parallel.

46 Claims, 4 Drawing Sheets

COLLAPSIBLE CONTAINER

TECHNICAL FIELD

The present invention relates to a collapsible container and in particular to a collapsible container that can be used as a portable building, and as a cargo container on ocean going vessels and on land transport vehicles, eg as a collapsible caravan, trailer, refuse bin or the like.

The invention has been developed primarily for these uses but will be described hereinafter with reference to use as a portable building and a cargo container. It should be appreciated, however, that the invention is not limited to these particular fields of use.

BACKGROUND ART

With portable buildings and cargo containers, arrangements are known which can be disassembled and transported as compact assemblies to be reassembled when required for use. Many of these arrangements have been characterised by a degree of difficulty in the disassembly and reassembly steps, that is, these steps have often required the use of heavy tools and have been cumbersome and time consuming.

Some of these containers are in the assembled form in the collapsed position (i.e. members joined to each other by various means). However, the joining arrangements of the various members to each other and the container base, have varied from being complex to cumbersome and from frail to excessively robust. Furthermore, erection of some of these containers has necessitated the performance of a number of intermediate steps, such as fastening of members to each other and the addition of extra members or materials, such as doors, lining, windows etc.

Conversely, some of these containers are in the form of a "kit of parts" in the disassembled form. Thus it has been necessary during assembly to reconnect, for example, the walls to the base, roof to the walls etc.; (disassembly being the reverse of this procedure).

It has sometimes also been necessary to attach wall inner and outer linings subsequent to wall erection, due to the container formation in the collapsed position not allowing prior attachment.

It would be preferable if these cumbersome and time consuming steps, often requiring the use of special tools, could be avoided. It would also be preferable if a container could be rapidly erected from the collapsed position for immediate use and that such a container be satisfactorily and/or aesthetically finished and weather proof (e.g. sealed) immediately upon erection. Furthermore, if a container could be provided that is compact, easily transportable and stackable with like containers, this would minimise transportation costs.

It is an aim of at least preferred form(s) of the present invention to provide a collapsible container which ameliorates the above deficiencies in a simple yet effective manner, or which will at the very least provide the public with a useful choice.

DISCLOSURE OF THE INVENTION

The present invention in a first aspect provides a collapsible container comprising:

a generally rectangular container base;

post members located at the corners of the base and extending generally upwards therefrom;

a pair of opposing end wall members and a pair of opposing side wall members, each mounted between a respective pair of post members via hinge means and moveable between an erected position wherein the wall member extends generally upwards from the container base and a collapsed position wherein the wall member generally overlays the container base, each wall member having side edges extending between inner and outer faces, the inner face lying closer to the container base than the outer face in the collapsed position;

the hinge means comprising a pair of hinge pins, each extending between a side edge of a wall member and a respective post member and being rotatably received and/or supported at one or both of the wall member and respective post member;

each post member additionally comprising receiving means disposed laterally adjacent thereto which is adapted for receiving and/or supporting the hinge pin of an end wall member such that when each wall member is in the erected position, the disposition of the receiving means enables each side edge of each end wall member to come into sealing engagement with the inner face of an adjacent side wall member to sealingly define the container outer wall.

The present invention in a second aspect provides a container base;

a plurality of post members extending generally upwardly from the container base; and a plurality of wall members, each mounted to at least one respective post member via hinge means and moveable between an erected position wherein the wall member extends generally away from the container base and a collapsed position wherein the wall member generally overlays the container base, each wall member having top, bottom and side edges extending between inner and outer faces, the inner face lying closer to the container base than the outer face in the collapsed position, the hinge means comprising a hinge pin extending between each wall member and respective post member, with each post member comprising receiving means disposed laterally adjacent thereto for receiving and/or supporting a hinge pin of an adjacent wall member, the hinge pin being rotatably supported at one or both of the wall member and respective post member, and the hinge pin being located on the side edge to project therefrom so as to be between parallel planes extending respectively from the inner and outer faces, and such that in the erected position, the pin is closer to that part of the inner face laterally adjacent the pin than the opposing and corresponding laterally adjacent part of the outer face, and is closer to the bottom edge than the top edge.

The arrangement of the receiving means of the present invention enables the container to be directly or automatically sealed upon erection without the need for any additional assembly steps. This results in considerable time saving and is therefore economically advantageous.

In the second aspect, it is preferred that each wall member is mounted by the hinge means between a respective pair of post members, with each post member mountedly supporting a pair of adjacent wall members.

In this regard it is preferred that at each post member one of the pins between one of the wall members and the post member is within a perimeter defined by the outer faces of the wall members in the erected position, whereas at least part of the other pin between the other wall member and the post member is outside this perimeter.

Preferably, each post member includes a receiving means disposed laterally adjacent thereto for receiving and/or supporting that hinge pin which lies within said perimeter.

Each wall member of the present invention can have cladding mounted to its inner face, the arrangement of the or each hinge pin on each wall member enabling the cladding to extend from the top edge and substantially down to the bottom edge without the inner face cladding interfering with movement of each wall member from the erected to the collapsed position.

Preferably sealing engagement between adjacent wall members is facilitated by the provision of sealing means which is operable between adjacent wall members in the erected position. In the first aspect it is preferred that sealing means is arranged on each side edge of the end wall members, or on that part of the inner face of each side wall member coming into sealing engagement with a respective end wall member side edge in the erected position.

Preferably the sealing means comprises one or more elastomeric sealing strips, the or each strip running longitudinally along a side edge of one of the adjacent wall members and engagingly deforming against the other wall member when in the erected position to seal the container outer wall.

The provision of sealing means further enhances container sealing in the erected position and can produce an air or fluid-tight container of great advantage.

Preferably the bottom edge of each wall member is arranged in the erected position to abut or be in close proximity to the container base, or a surface generally parallel to the container base. Preferably, the bottom edge, the container base and said surface are all planar, such that the bottom edge is flush with or parallel to respectively the container base or said surface in the erected position, and the positioning of the or each hinge pin on each wall member is such that the wall member is prevented from collapsing outwardly due to the interaction of the bottom edge with respectively the container base or said surface. Preferably said surface is an upwardly disposed face of a panel or a post, the panel or post extending generally upwardly from the container base and the wall member being vertically aligned with and above the panel or post when in the erected position.

The preferred hinge means arrangement of the present invention enables a rapid erection of the container, and also enables the wall members to lie in the collapsed position with internal and/or external cladding fixed thereon.

In a more preferred form of the present invention, when a wall member is mounted to the container base such that in the erected position the wall member bottom edge abuts to sit squarely against either:

(i) the container base; or (ii) a panel or post projecting upwardly from the container base and presenting an upwardly disposed opposing face against which the bottom edge abuts;

the orientation of the hinge means of the present invention prevents the wall member rotating beyond the erected position (i.e. prevents the wall member when rotated from the collapsed position to the erected position from rotating beyond the erected position and outwardly away from the container).

The preferred hinge means arrangement of the present invention also enables each wall member to be provided with external cladding such that when each wall mender is in the erected position, the external cladding can extend from the top to at least the bottom edge of the wall member, and preferably beyond the bottom edge. The hinge means also enables the internal cladding to be arranged such that when in the erected position the cladding can extend downwardly to be close to or to reach the bottom edge of the wall member or to corresponding internal cladding extending upwardly from the container base optionally mounted to the panel and/or post (and in such an arrangement, the amount of corresponding internal cladding required would depend on the wall members relative proximity to the container base).

The side, top and bottom edges of the wall member can be provided with the elastomeric sealing strips as can the abutment surfaces of the wall member with the upwardly extending internal and external cladding panels. As stated above, such sealing strips enhance container sealing upon erection.

Preferably each hinge pin is located on a respective side edge and adjacent the bottom edge of the wall member and preferably each hinge pin is located on the side edge such that it is equidistantly offset from the outer face and bottom edge.

Preferably each hinge pin is received for rotation in a corresponding recess in one or both of the respective side edge and post member. Thus, each hinge pin can be fixed to the post member and rotatable within the side edge.

Typically each hinge pin would be mounted to a body portion for retaining in the respective side edge and would extend from the body portion for receipt in the side edge or the post member.

The body portion can be a generally rectangular block and the hinge pin can be a generally cylindrical member extending orthogonally from one face of the rectangular block and being offset from the centre of this face and preferably the generally cylindrical member is rotatably retained in a corresponding cylindrical recess in the post member.

Preferably the body portion is arranged in the side edge such that the hinge pin is parallel to the inner face and projects orthogonally from the side edge or the post member. The body portion may then be arranged at or adjacent the corner of the wall member where the side edge meets the bottom edge or in the post member itself.

Preferably each wall member is rotatable about an axis of rotation between the erected and collapsed positions, the axis extending through a pair of hinge pins when the wall member has each pin located at an opposing side edge thereof.

Preferably the hinge pins are all of the same length. When the body portions are all the same size, the hinge pin/body portion unit can be fabricated identically for use throughout the container, resulting in savings in cost and time.

Preferably each wall member is mounted at a position on its respective post members such that in the collapsed position, the wall members generally overlay each other adjacent the container base so that each is generally parallel thereto. It is preferable that the post members extend upwardly from the base to be substantially the same height as the height of the wall members in the collapsed position, the post members being adapted such that when the wall members are in the collapsed position, the post members can inter-engage corresponding post members on a like container to enable stacking of the containers.

Preferably, the container is provided with a roof member mountable on the plurality of wall members when in the erected position to enclose the container, with the roof member being adapted to lock the wall members together in the erected position. Preferably the roof member is also engageable with the plurality of post members when the wall members are in the collapsed position. When engaged with the post members in the collapsed position, the roof member can also be adapted to receive corresponding post members on a like container to enable stacking of the containers.

BRIEF DESCRIPTION OF THE DRAWINGS

The invention will now be described, by way of example only, with reference to the accompanying drawings in which.

MODES FOR CARRYING OUT THE INVENTION

Figure 1:
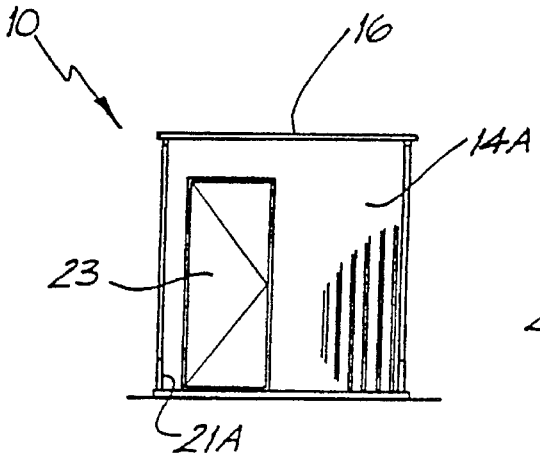
FIGS. 1 to 4 detail respectively four elevations of a collapsible container embodying the invention and shown in the form of a portable building.
Figure 3:
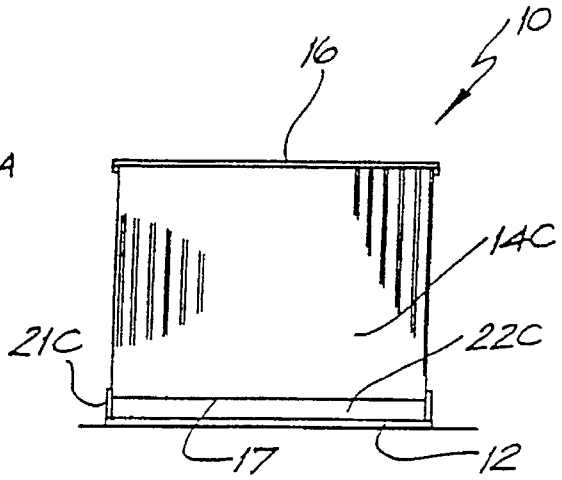
Figure 2:
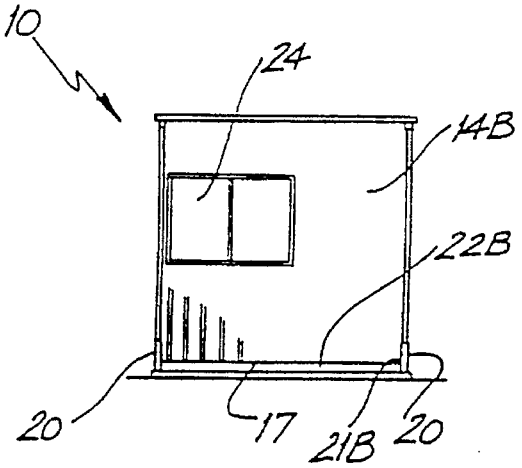
Figure 4:
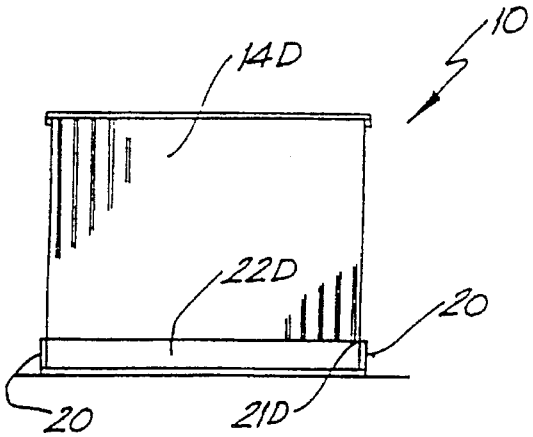

Referring to the drawings, the collapsible container is hereinafter described in a preferred form as a portable building 10. The building has a floor 12, walls 14 and a roof 16. The walls are hingedly mounted to the floor at their base 17 via support members in the form of posts 20 at hinge points 21.

FIGS. 1 to 4 and FIG. 5 show the portable building in an erected position, in which the walls extend orthogonally upwardly from the floor.

Four respective elevations are shown in FIGS. 1 to 4 in which the walls are designated respectively 14A, 14B, 14C and 14D. The walls 14A, B, C and D are mounted on the posts at respective hinge points 21A, B, C and D. The hinge points are at progressively increasing distances from the floor. When the walls are displaced towards a collapsed position (e.g. the walls overlay each other such that each wall is approximately parallel to the floor) the relative positioning of the walls on the posts enables the attainment of a compact collapsed formation. Thus, in the form shown in FIGS. 1 to 4, wall 14A would be layed adjacent the floor first, wall 14B second, wall 14C third and wall 14D last.

It can also be seen in FIGS. 1 to 4 that walls 14A and 14B are held in the erected position between walls 14C and 14D respectively. Thus the side walls of walls 14A and 14B abut against the inner wall surfaces of walls 14C and 14D respectively in the erected position. A rubber sealing strip can be provided between the side walls and respective inner wall surfaces so that the walls immediately seal the four corners of the building upon erection. This enhances the sealing of the building interior from the surrounds.

The building is also provided with panels 22B, C and D which extend from the floor up to walls 14B, C and D respectively. These panels function to provide a continuous internal and external wall surface from the floor to the roof. A rubber sealing strip may also be provided between each panel on an upper face of the panel, and the respective wall base adjacent thereto, to seal any space between the wall base and its respective panel in the erected position. In addition to this, the wall member may have external cladding which extends downwardly beyond the highest point of the panel (see FIG. 6) optionally having a sealing strip located between the external cladding and an outer face of the panel. This further facilitates sealing of the building and can enhance the overall aesthetic appearance of the structure.

Figure 5:
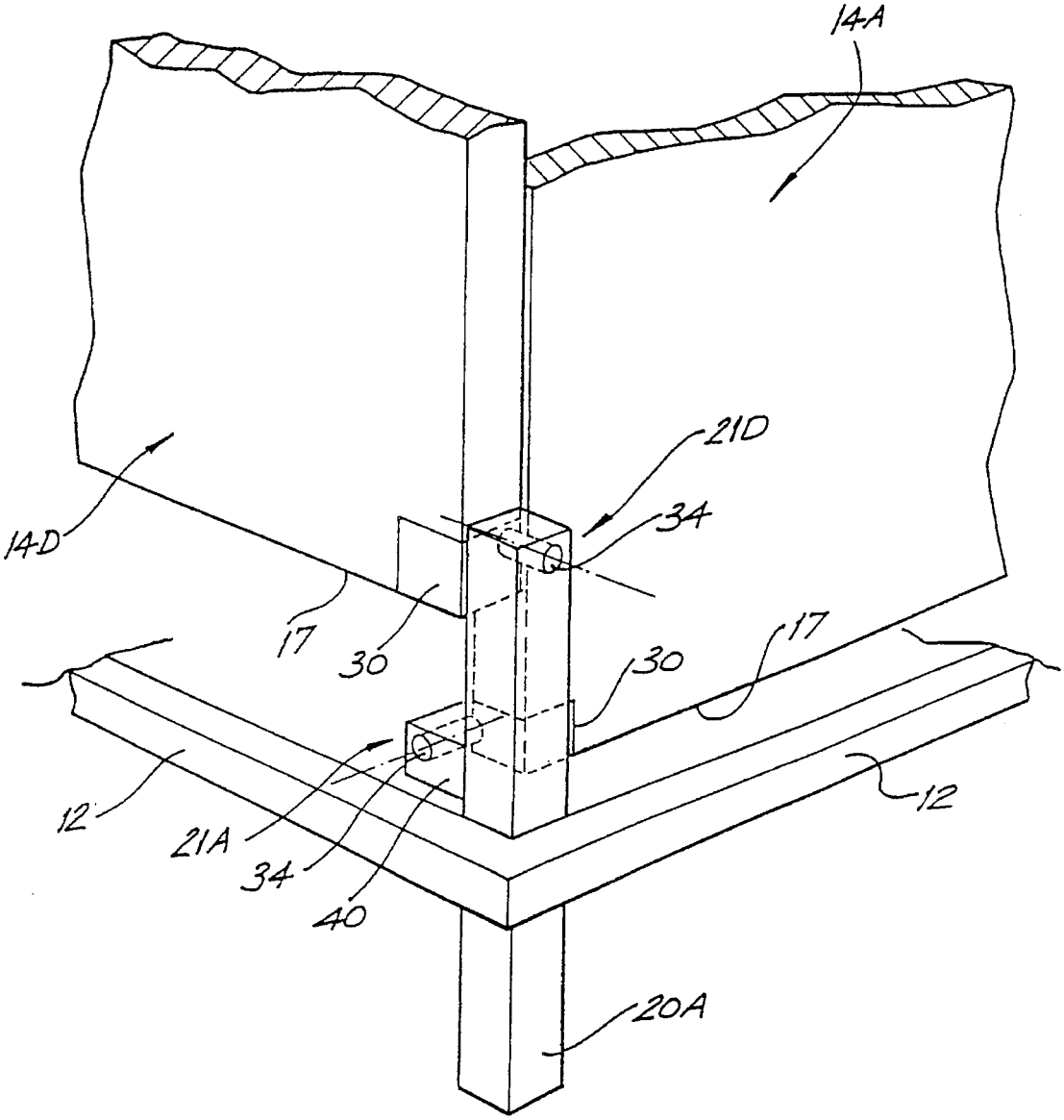
FIG. 5 shows a perspective view of a corner section of the portable building of FIGS. 1 and 4.

Referring to FIG. 5, the panels 22 have been removed to reveal more clearly the hinge points 21A and 21D.

Figure 8:
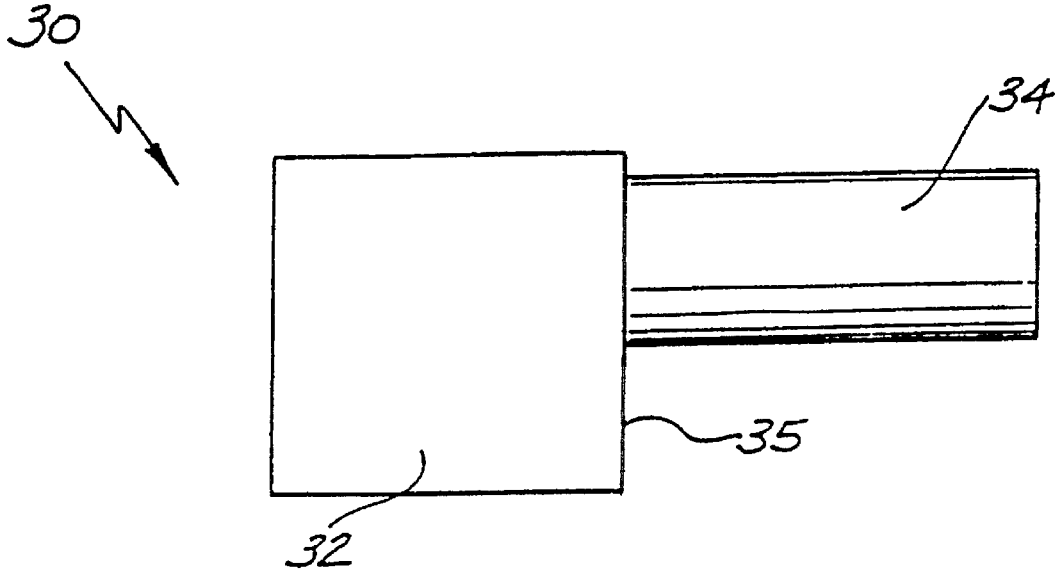
FIGS. 8 and 9 detail respectively side and end views of the preferred hinge means for use in the portable building.
Figure 9:
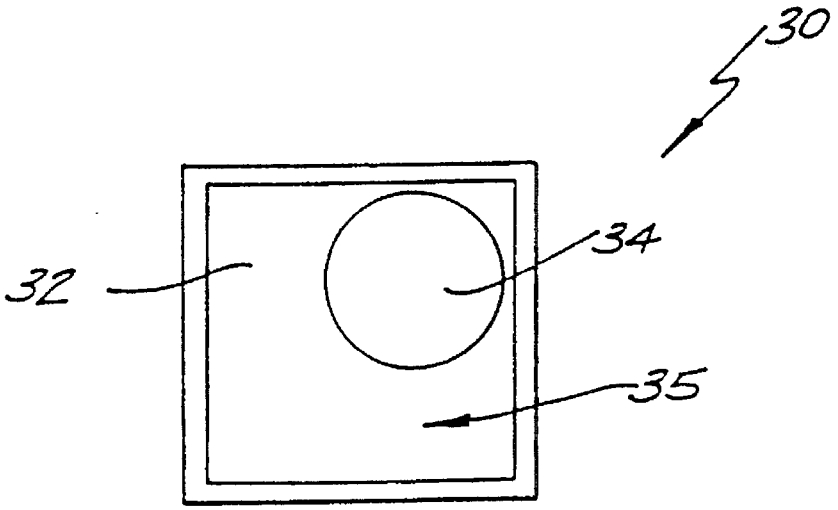

The corners of the wall bases 17 are each provided with a hinge device 30 (detailed in FIGS. 8 and 9). The hinge device 30 has a body 32 which is retained in the wall 14. A cylindrical pin 34 extends orthogonally from, and offset from the centre of, a face 35 of the body. The cylindrical pin is received in a corresponding recess in the post 20 and is free to rotate within the recess.

Post 20 is provided with leg 20A, and a lug 40. The lug receives the cylindrical pin of the hinge device of wall 14A so that in the erect position, this wall may align with the adjacent wall 14D to effectively seal the corner of the portable building.

This arrangement facilitates rapid assembly of the building as no additional construction steps are required to seal the corners of the building when the walls are raised from the collapsed to the erect position. Advantageously, this arrangement also allows the employment of the same hinge device 30 at each of the wall lower corners, resulting in considerable savings in manufacturing and erection costs and time.

Figure 6:
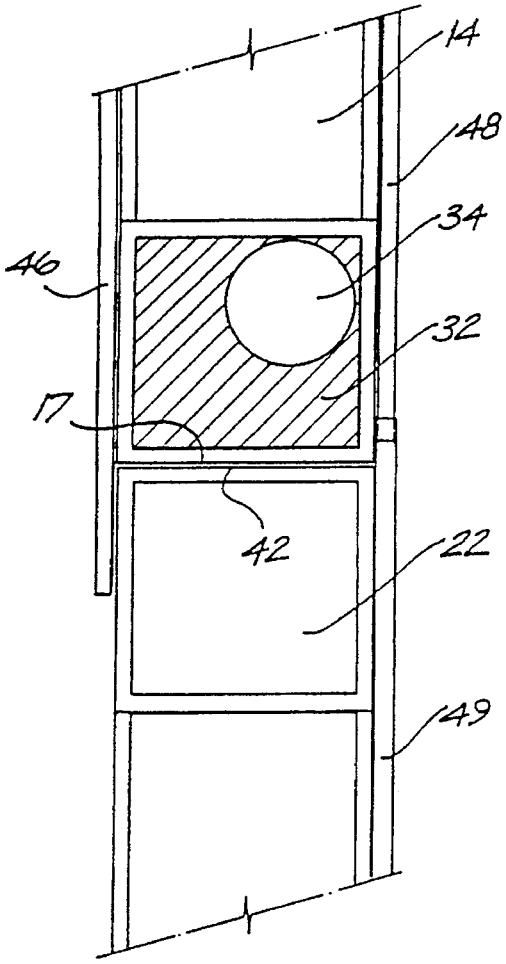
FIGS. 6 and 7 show a sectional side elevation through a wall member and preferred hinge means for the portable building.
Figure 7:
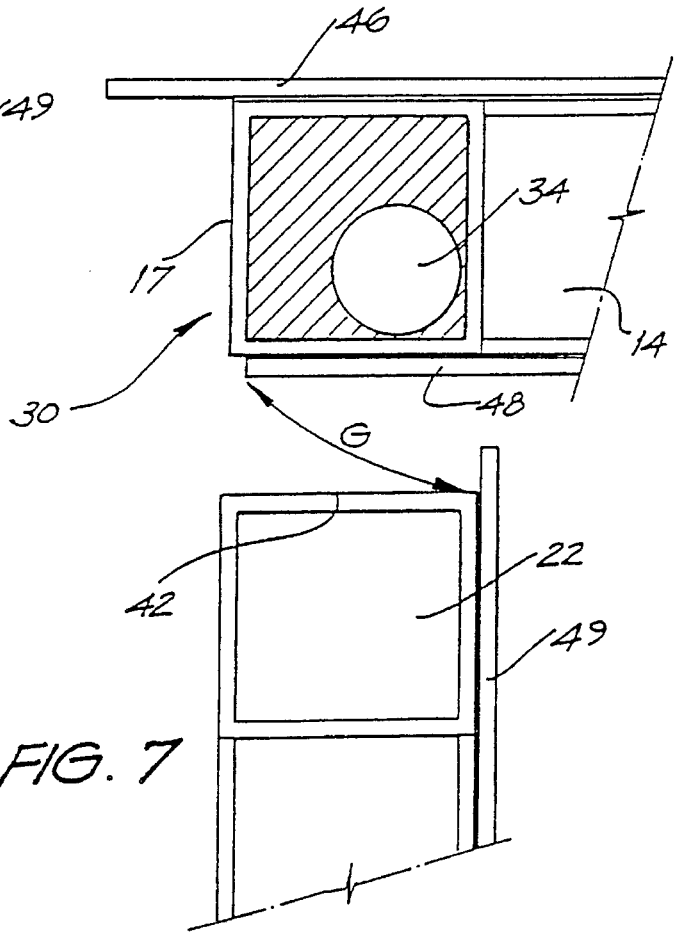

Referring to FIGS. 6 and 7, FIG. 6 shows a wall in the erect position wherein the wall base 17 is adjacent and parallel to panel upper face 42. The wall is also provided with external cladding 46 and internal cladding 48 whilst the panel has internal cladding 49.

As can be seen in FIG. 6, external cladding 46 extends downwardly to overlap panel 22 and seal the portable building when the wall is in the erect position. In this position internal cladding 48 also aligns and overlaps with internal cladding 49 to provide a continuous internal wall in the building.

When roof 16 of the building is removed, the walls can be pivotally displaced towards the floor. FIG. 7 shows this displacement. The wall is pivoted at hinge device 30 about cylindrical pin 34 as indicated by arrow G. The offset location of cylindrical pin 34 allows this displacement without cladding 48 catching panel upper face 42. This offset location also prevents outward pivotal displacement of the wall away from the portable building. Namely, when the wall is in the erect position (FIG. 6), base 17 sits squarely on panel upper face 42 and any attempt to displace the wall outwardly is resisted by pin 34 and the square or flush orientation of base 17 on panel upper face 42.

The underside of roof 16 is provided with means for engaging the upper edges of walls 14 (not shown) which means can also engage posts 20 when the walls of the portable building are in the collapsed position, the roof being arranged on top of the four posts respectively at its four corners. The upper side of the roof is also provided with means for engaging post legs 20A. Thus an identical portable building can be arranged on top of the roof 16. (Alternatively, the identical portable building can be stacked directly on the posts with the roof removed). In this way, a sizeable stack of compact collapsed portable buildings can be achieved which stack may be easily transported. Transportation of the containers can also be facilitated by the locking together of post legs on like containers by any convenient locking means, enabling container stacks (i.e. comprising a plurality of containers) with some or all of the containers in either the collapsed or erected conditions to be transported; e.g. by crane.

The preceding description applies equally to cargo and other types of containers. The containers according to the present invention can be used as collapsible caravans, trailers, refuse bearers and the like with appropriate modifications being made for the particular application. The preferred sealing means employed enables the containers to transport fluid-bearing refuse, or to effectively seal the container interior from the surroundings, for example, when the container is used in damp or wet climates/environments. Thus, when not in use, collapsible containers according to the invention can be rapidly disassembled and stacked in a compact and space saving way, also saving on transportation costs.

Typically the containers are formulated from pressed metal with the frames being welded together from metal sections.

Whilst the invention has been described with reference to a particular embodiment it will be appreciated that the invention can be embodied in many other forms.

I claim:

1. A collapsible container comprising:

a container base;

a plurality of post members extending generally upwardly from the container base;

a plurality of wall members, each mounted between a respective pair of post members via hinge means and moveable between an erected position wherein the wall member extends generally away from the container base and a collapsed position wherein the wall member generally overlays the container base, each wall member having top, bottom and side edges extending between inner and outer faces, the inner face lying closer to the container base than the outer face in the collapsed position, the hinge means comprising a pair of hinge pins each extending between a side edge of a wall member and a respective post member, each hinge pin being rotatably supported at one or both of the wall member and post member and located on the side edge closer to the inner face than the outer face and closer to the bottom edge than the top edge;

each post member being adapted to support a hinge pin of one of the wall members and additionally comprising receiving means extending laterally from the post member, the receiving means being adapted for supporting a hinge pin of an adjacent wall member;

such that when each wall member is in the erected position, the arrangement of the receiving means enables sealing engagement between said one of the wall members and said adjacent wall member to sealingly define the container outer wall; and each wall member has cladding mounted to its outer face, the outer face cladding extending beyond the bottom edge of the wall member so that in the erected position it is parallel to and adjacent a respective panel or post member and assists in sealingly defining the container outer wall.

2. A collapsible container as claimed in claim 1, wherein:

each hinge pin projects from the side edge so as to be between parallel planes extending respectively from the inner and outer faces, and such that in the erected position, the pin is closer to that part of the inner face laterally adjacent the pin than the opposing and corresponding laterally adjacent part of the outer face, and is closer to the bottom edge than the top edge.

3. A collapsible container as claimed in claim 2, wherein each wall member is mounted by the hinge means between a respective pair of post members, with each post member mountedly supporting a pair of adjacent wall members.

4. A collapsible container as claimed in claim 3, wherein at each post member one of the pins between one of the wall members and the post member is within a perimeter defined by the outer faces of the wall members in the erected position, whereas at least part of the other pin between the other wall member and the post member is outside this perimeter.

5. A collapsible container as claimed in claim 4, wherein the receiving means lies within said perimeter.

6. A collapsible container as claimed in claim 1, wherein each wall member has cladding mounted to its inner face, the arrangement of the or each hinge pin on each wall member enabling the cladding to extend from the top edge and substantially down to the bottom edge without the inner face cladding interfering with movement of each wall member from the erected to the collapsed position.

7. A collapsible container as claimed in claim 1 wherein sealing engagement between adjacent wall members is facilitated by the provision of sealing means which is operable between adjacent wall members in the erected position.

8. A collapsible container as claimed in claim 1, wherein sealing means is arranged on each side edge of the end wall members or on that part of the inner face of each side wall member coming into sealing engagement with a respective end wall member side edge in the erected position.

9. A collapsible container as claimed in claim 7, wherein the sealing means comprises at least one elastomeric sealing strip, each strip running longitudinally along a side edge of one of the adjacent wall members and engagingly deforming against the other wall member when in the erected position to seal the container outer wall.

10. A collapsible container as claimed in claim 1, wherein the bottom edge of each wall member is arranged in the erected position in close proximity to the container base, or a surface generally parallel to the container base.

11. A collapsible container as claimed in claim 10, wherein the bottom edge, the container base and said surface are all planar, such that the bottom edge is parallel to respectively the container base or said surface in the erected position, and the positioning of each hinge pin on each wall member is such that the wall member is prevented from collapsing outwardly due to the interaction of the bottom edge with respectively the container base or said surface.

12. A collapsible container as claimed in claim 11, wherein said surface is an upwardly disposed face of a panel or a post, the panel or post extending generally orthogonally upwards from the container base and the wall member being vertically aligned with and above the panel or post when in the erected position.

13. A collapsible container as claimed in claim 1, wherein each hinge pin is integral with and extends from a body portion which is adjacent each corner of each wall member where the bottom and side edges intersect and wherein the body portion is a generally rectangular block and the hinge pin is a generally cylindrical member extending orthogonally from one face of the rectangular block, the block being retained in a wall member or at a post member so that the hinge pin is parallel to the inner face and extends orthogonally with respect to the side edge.

14. A collapsible container as claimed in claim 1, wherein each hinge pin when supported between a wall member and respective post member is equidistantly offset from the bottom edge and outer face.

15. A collapsible container as claimed in claim 1, wherein each wall member is rotatable about an axis of rotation between the erected and collapsed positions, the axis extending through a pair of hinge pins when the wall member has each pin located at an opposing side edge thereof.

16. A collapsible container as claimed in claim 1 wherein each wall member is mounted at a respective position above the container base such that in the collapsed position, the wall members generally overlay each other, so that each is generally parallel thereto.

17. A collapsible container as claimed in claim 1 wherein the post members extend upwardly from the base to be substantially the same height as the height of the wall members in the collapsed position, the post members being adapted such that when the wall members are in the collapsed position, the post members can interengage corresponding post members on a like container to enable stacking of the containers.

18. A collapsible container as claimed in claim 1 further comprising a roof member mountable on the plurality of wall members when in the erected position to enclose the container, the roof member being adapted to lock the wall members together in the erected position and being engageable with the plurality of post members when the wall members are in the collapsed position.

19. A collapsible container as claimed in claim 18, wherein the roof member is further adapted to receive corresponding post members on a like container to enable stacking of the containers with the wall members in either the collapsed or erected positions.

20. A collapsible container as claimed in claim 1, wherein the end wall member which is closest to the container base when in the collapsed position is adapted for having a door formed therein.

21. A collapsible container as claimed in claim 20, wherein said end wall member which is closest to the container base is mounted to the receiving means such that in the collapsed position, the wall member inner face lies flush with the container base.

22. A collapsible container as claimed in claim 8, wherein the sealing means comprises at least one elastomeric sealing strip, each strip running longitudinally along a side edge of one of the adjacent wall members and engagingly deforming against the other wall member when in the erected position to seal the container outer wall.

23. A collapsible container as claimed in claim 8, wherein the end wall member which is closest to the container base when in the collapsed position is adapted for having a door formed therein.

24. A collapsible container as claimed in claim 11, wherein the end wall member which is closest to the container base when in the collapsed position is adapted for having a door formed therein.

25. A collapsible container as claimed in claim 12, wherein the end wall member which is closest to the container base when in the collapsed position is adapted for having a door formed therein.

26. A collapsible container as claimed in claim 11, wherein each wall member has cladding mounted to its outer face, the outer face cladding extending beyond the bottom edge of the wall member so that in the erected position it is parallel to and adjacent a respective panel or post and assists in sealingly defining the container outer wall.

27. A collapsible container as claimed in claim 11, wherein each hinge pin is integral with and extends from a body portion which is adjacent each corner of each wall member where the bottom and side edges intersect, and wherein the body portion is a generally rectangular block and the hinge pin is a generally cylindrical member extending orthogonally from one face of the rectangular block, the block being retained in a wall member or at a post member so that the hinge pin is parallel to the inner face and extends orthogonally with respect to the side edge.

28. A collapsible container as claimed in claim 11, wherein each hinge pin when supported between a wall member and respective post member is equidistantly offset from the bottom edge and outer face.

29. A collapsible container as claimed in claim 11, wherein each wall member is rotatable about an axis of rotation between the erected and collapsed positions, the axis extending through a pair of hinge pins when the wall member has each pin located at an opposing side edge thereof.

30. A collapsible container as claimed in claim 11, wherein each wall member is mounted at a respective position above the container base such that in the collapsed position, the wall members generally overlay each other, so that each is generally parallel thereto.

31. A collapsible container as claimed in claim 11, wherein the post members extend upwardly from the base to be substantially the same height as the height of the wall members in the collapsed position, the post members being adapted such that when the wall members are in the collapsed position, the post members can interengage corresponding post members on a like container to enable stacking of the containers.

32. A collapsible container as claimed in claim 11, further comprising a roof member mountable on the plurality of wall members when in the erected position to enclose the container, the roof member being adapted to lock the wall members together in the erected position and being engageable with the plurality of post members when the wall members are in the collapsed position.

33. A collapsible container as claimed in claim 12, wherein each wall member has cladding mounted to its outer face, the outer face cladding extending beyond the bottom edge of the wall member so that in the erected position it is parallel to and adjacent respective panel or post and assists in sealingly defining the container outer wall.

34. A collapsible container as claimed in claim 12, wherein each hinge pin is integral with and extends from a body portion which is retained each corner of each wall member where the bottom and side edges intersect, and wherein the body portion is a generally rectangular block and the hinge pin is a generally cylindrical member extending orthogonally from one face of the rectangular block, the block being retained in a wall member or at a post member so that the hinge pin is parallel to the inner face and extends orthogonally with respect to the side edge.

35. A collapsible container as claimed in claim 12, wherein each hinge pin when supported between a wall member and respective post member is equidistantly offset from the bottom edge and outer face.

36. A collapsible container as claimed in claim 12, wherein each wall member is rotatable about an axis of rotation between the erected and collapsed positions, the axis extending through a pair of hinge pins when the wall member has each pin located at an opposing side edge thereof.

37. A collapsible container as claimed in claim 12, wherein each wall member is mounted at a respective position above the container base such that in the collapsed position, the wall members generally overlay each other, so that each is generally parallel thereto.

38. A collapsible container as claimed in claim 12, wherein the post members extend upwardly from the base to be substantially the same height as the height of the wall members in the collapsed position, the post members being adapted such that when the wall members are in the collapsed position, the post members can interengage corresponding post members on a like container to enable stacking of the containers.

39. A collapsible container as claimed in claim 12, further comprising a roof member mountable on the plurality of wall members when in the erected position to enclose the container, the roof member being adapted to lock the wall members together in the erected position and being engageable with the plurality of post members when the wall members are in the collapsed position.

40. A collapsible container comprising:

a container base;

a plurality of post members extending generally upwardly from the container base;

a plurality of wall members, each mounted between a respective pair of post members via hinge means and moveable between an erected position wherein the wall member extends generally away from the container base and a collapsed position wherein the wall member generally overlays the container base, each wall member having top, bottom and side edges extending between inner and outer faces, the inner face lying closer to the container base than the outer face in the collapsed position, the hinge means comprising a pair of hinge pins each extending between a side edge of a wall member and a respective post member, each hinge pin being rotatably supported at one or both of the wall member and post member and located on the side edge closer to the inner face than the outer face and closer to the bottom edge than the top edge;

each post member being adapted to support a hinge pin of one of the wall members and additionally comprising receiving means extending laterally from the post member, the receiving means being adapted for receiving a hinge pin of an adjacent wall member;

such that when each wall member is in the erected position, the arrangement of the receiving means enables sealing engagement between said one of the wall members and said adjacent wall member to sealingly define the container wall; each wall member having cladding mounted to its outer face, the outer face cladding extending beyond the bottom edge of the wall member so that in the erected position it is parallel to and adjacent a respective panel or post and assists in sealingly defining the container outer wall; and wherein the bottom edge of each wall member is arranged in the erected position in close proximity to the container base, or a surface generally parallel to the container base, and the bottom edge, the container base and said surface are all planar, such that the bottom edge is parallel to respectively the container base or said surface in the erected position, and the positioning of each hinge pin on each wall member is such that the wall member is prevented from collapsing outwardly due to the interaction of the bottom edge with respectively the container base or said surface.

41. A collapisble container comprising:

a container base;

a plurality of post members extending generally upwardly from the container base;

a plurality of wall members, each mounted between a respective pair of post members via hinge means and moveable between an erected position wherein the wall member extends generally away from the container base and collapsed position wherein the wall member generally overlays the container base, each wall member having top, bottom and side edges extending between inner and outer faces, the inner face lying closer to the container base than the outer face in the collapsed position, the hinge means comprising a pair of hinge pins each extending between a side edge of a wall member and a respective post member, each hinge pin being rotatably supported at one or both of the wall member and post member and located on the side edge closer to the inner face than the outer face and closer to the bottom edge than the top edge;

each post member being adapted to receive a hinge pin of one of the wall members and additionally comprising receiving means extending laterally from the post member, the receving means being adapted for receving a hinge pin of an adjacent wall member;

such that when each wall member is in the erected position, the arrangement of the receiving means enables sealing engagement between said one of the wall members and said adjacent wall member to sealingly define the container outer wall; each wall member having cladding mounted to its outer face, the outer face cladding extending beyond the bottom edge of the wall member so that in the erected position it is parallel to and adjacent a respective panel or post and assists in sealingly defining the container outer wall.

42. A collapsible container as claimed in claim 1, wherein the bottom edge of each wall member is arranged in the erected position to abut the container base, or a surface generally parallel to the container base.

43. A collapsible container as claimed in claim 1 wherein each wall member is mounted at a respective position above the container base such that in the collapsed position, the wall members generally overlay the container base, so that each is generally parallel thereto.

44. A collapsible container as claimed in claim 11, wherein each wall member is mounted at a respective position above the container base such that in the collapsed position, the wall members generally overlay the container base, so that each is generally parallel thereto.

45. A collapsible container as claimed in claim 12, wherein each wall member is mounted at a respective position above the container base such that in the collapsed position, the wall members generally overlay the container base, so that each is generally parallel thereto.

46. A collapsible container as claimed in claim 11, wherein the receiving means comprises a lug projecting laterally from each post member.

* * * * *

UNITED STATES PATENT AND TRADEMARK OFFICE

CERTIFICATE OF CORRECTION

PATENT NO. : 5,501,353

DATED : March 26, 1996

INVENTOR(S) : Gary F. WARREN

It is certified that error appears in the above-indentified patent and that said Letters Patent is hereby corrected as shown below:

Claim 33, Col. 10, line 38, insert --a-- after "adjacent".

Signed and Sealed this

Twenty-fifth Day of June, 1996

*Attest:*

Bruce Lehman

BRUCE LEHMAN

*Attesting Officer*

*Commissioner of Patents and Trademarks*